US006543072B2

(12) United States Patent
Hsu

(10) Patent No.: US 6,543,072 B2
(45) Date of Patent: Apr. 8, 2003

(54) KNAPSACK-TYPE SLEEPING BAG

(76) Inventor: Amy Hsu, 9-14 Fl., No. 225, Sec. 3, Pa Te Rd., Taipei (TW)

( * ) Notice: Subject to any disclaimer, the term of this patent is extended or adjusted under 35 U.S.C. 154(b) by 0 days.

(21) Appl. No.: 09/771,628

(22) Filed: Jan. 30, 2001

(65) Prior Publication Data

US 2002/0100120 A1 Aug. 1, 2002

(51) Int. Cl.[7] ..... A47G 9/06
(52) U.S. Cl. ..... 5/413 R; 5/417; 5/419
(58) Field of Search ..... 5/413 R, 413 AM, 5/417, 419, 420; 382/2, 120; 224/153, 154, 156; 135/128, 96

(56) References Cited

U.S. PATENT DOCUMENTS 5,005,235 A * 4/1991 Huang ..... 2/69.5
5,210,891 A * 5/1993 Avital et al. ..... 224/156
5,785,219 A * 7/1998 Kraft ..... 2/66

FOREIGN PATENT DOCUMENTS

TW 48369 1/1983
TW 339618 9/1998

* cited by examiner

*Primary Examiner*—Heather Shackelford
*Assistant Examiner*—Fredrick Conley
(74) *Attorney, Agent, or Firm*—Rabin & Berdo, P.C.

(57) ABSTRACT

A knapsack-type sleeping bag includes a knapsack portion and a sleeping-bag portion having an edge integrally connected to a lining of the knapsack portion. The knapsack portion is provided with an opening openably closed with a zipper. The sleeping-bag portion, when it is not in use, is compressible and foldable into a compact body for receiving in the knapsack portion via the opening. To use the sleeping-bag portion, simply unzip the opening and pull the sleeping-bag portion out of the knapsack portion via the opening. The sleeping-bag portion pulled out of the knapsack portion can be unzipped and turned open to provide an expanded pad. A waterproof and/or insulating fabric can be detachably attached to a top of the turned open sleeping bag to protect the latter from getting dirt.

1 Claim, 6 Drawing Sheets

KNAPSACK-TYPE SLEEPING BAG

BACKGROUND OF THE INVENTION

The present invention relates to a sleeping bag, and more particularly to a knapsack-type sleeping bag having a sleeping-bag portion and a knapsack portion integrally connected to the sleeping-bag portion and receiving the sleeping-bag portion when the same is not in use.

In planning and preparing a short-term trip or an outdoor activity, such as a picnic, people would usually pack a large number of needed items into many bags. These bags often form an unpleasant burden to people and have adverse influences on the trip or the outdoor activity.

A sleeping bag is usually needed in such short-term trip or outdoor activity and inevitably increases the number of packages to be carried.

It is therefore desirable to develop a sleeping bag associated with a knapsack to reduce the number of packages to be carried by people in trip and outdoor activity.

In Taiwanese Patent Application entitled "Multipurpose Knapsack with Attached Sleeping Bag" laid open under Pub. No. 48369, there is disclosed a knapsack, to a bottom of which a sleeping bag is attached to replace an otherwise needed waterproof ground cloth in a tent. In this invention, the knapsack and the sleeping bag are actually two independent items only connected to each other at a predetermined position.

In Taiwanese Patent Application entitled "A Sleeping Bag" laid open under Pub. No. 339618, there is disclosed a sleeping bag having a projected end serving as a storage bag. When the sleeping bag is not in use, it may be packed in the storage bag. And, when the sleeping bag is in use and pulled out of the storage bag, a pillow may be received in the storage bag. In this invention, the sleeping bag has only one function as a sleeping bag and only the way to carry it is changed.

SUMMARY OF THE INVENTION

A primary object of the present invention is to provide a knapsack-type sleeping bag that associates a knapsack with a sleeping bag to form an integral body without increasing dimensions of the knapsack.

Another object of the present invention is to provide a knapsack-type sleeping bag in which the sleeping bag can be pulled out of the knapsack and flatly spread to provide an expanded pad.

A further object of the present invention is to provide a knapsack-type sleeping bag, to an inner surface of which a waterproof and/or insulating fabric is detachably attached to protect the inner surface of the sleeping bag from getting dirt easily. And the detachably attached fabric can also be easily replaced for cleaning.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
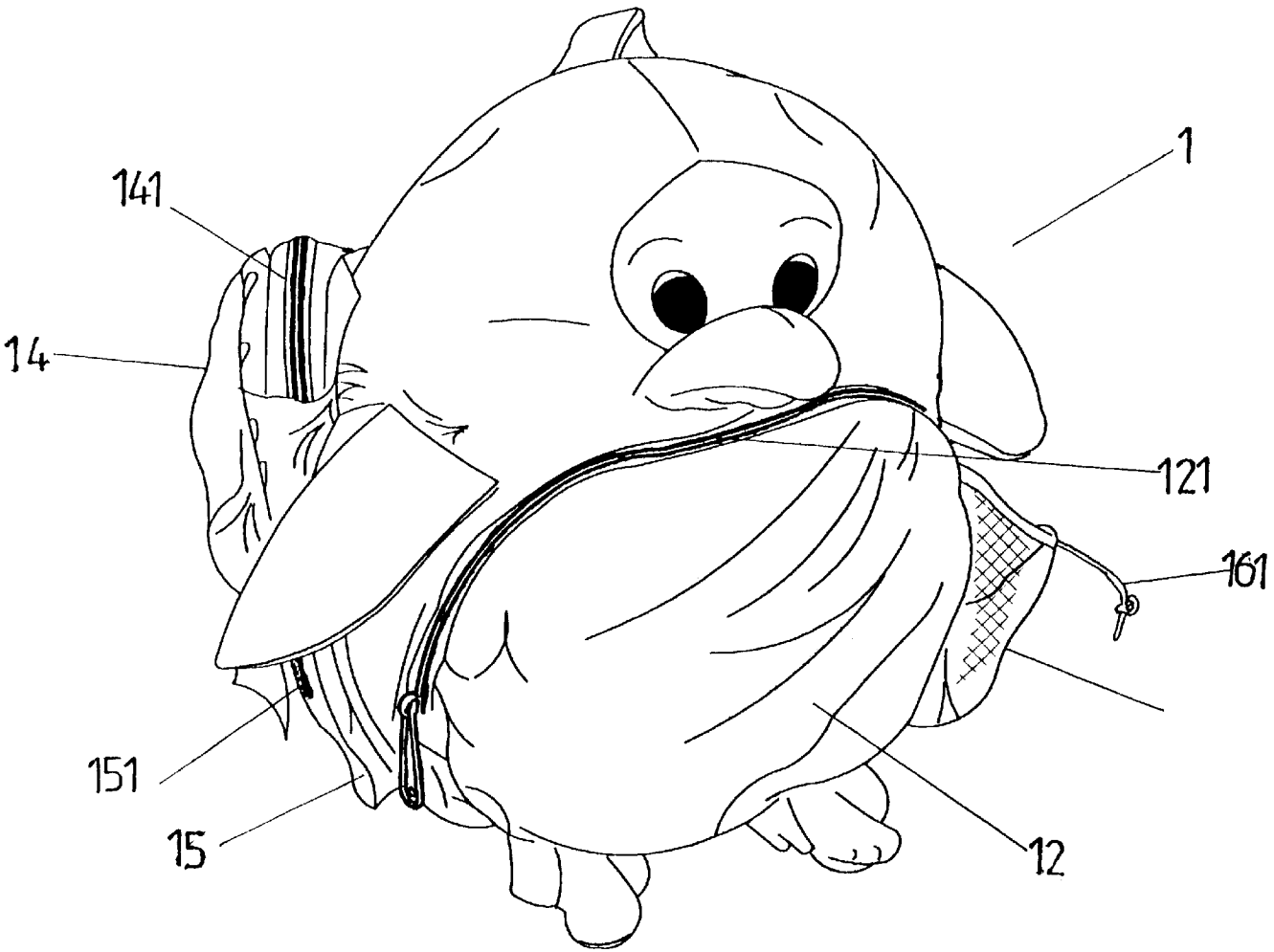
FIG. 1 is a front perspective view of a knapsack-type sleeping bag of the present invention in a folded state.
Figure 2:
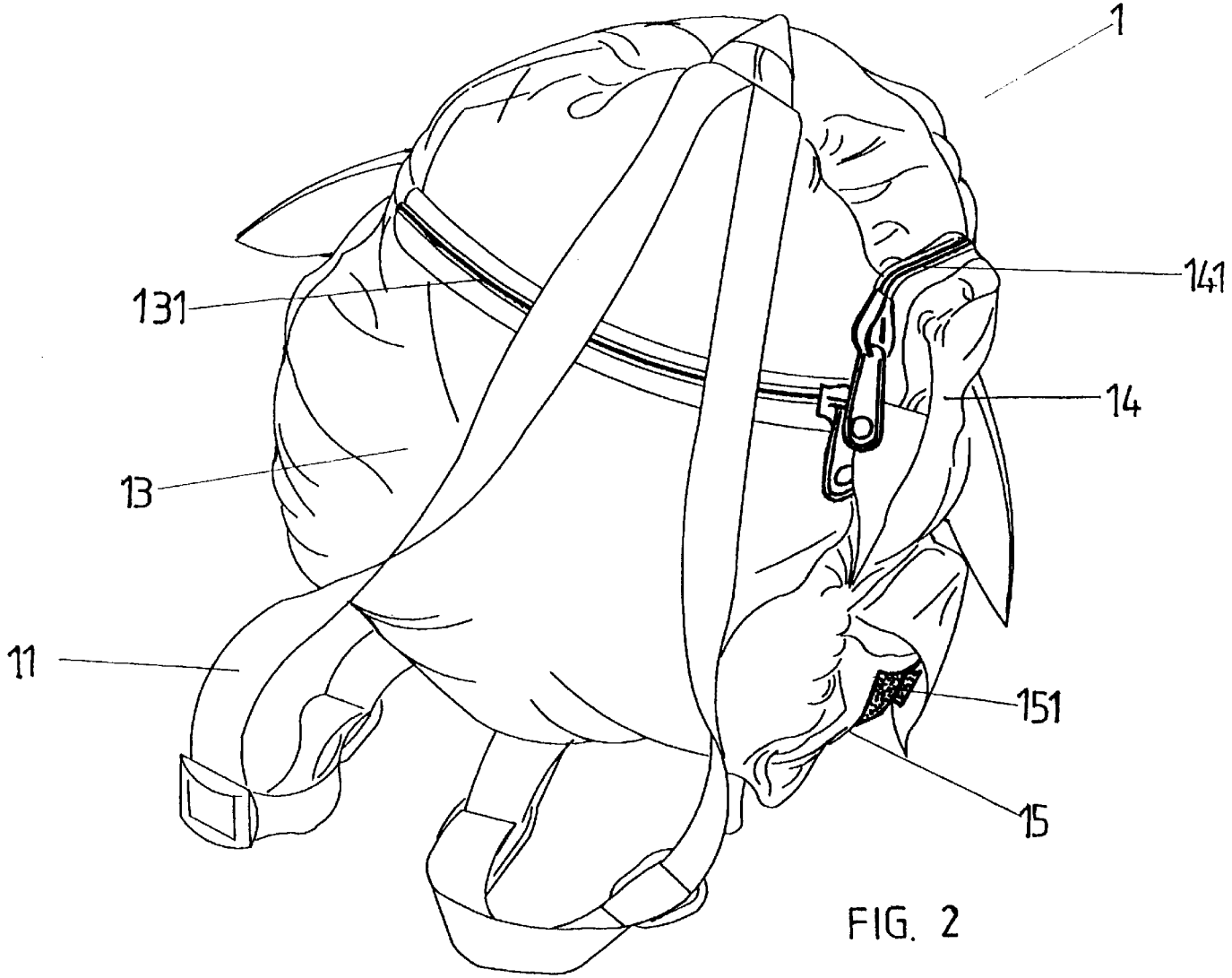
FIG. 2 is a back perspective view of the knapsack-type sleeping bag of FIG. 1 in the folded state.
Figure 3:
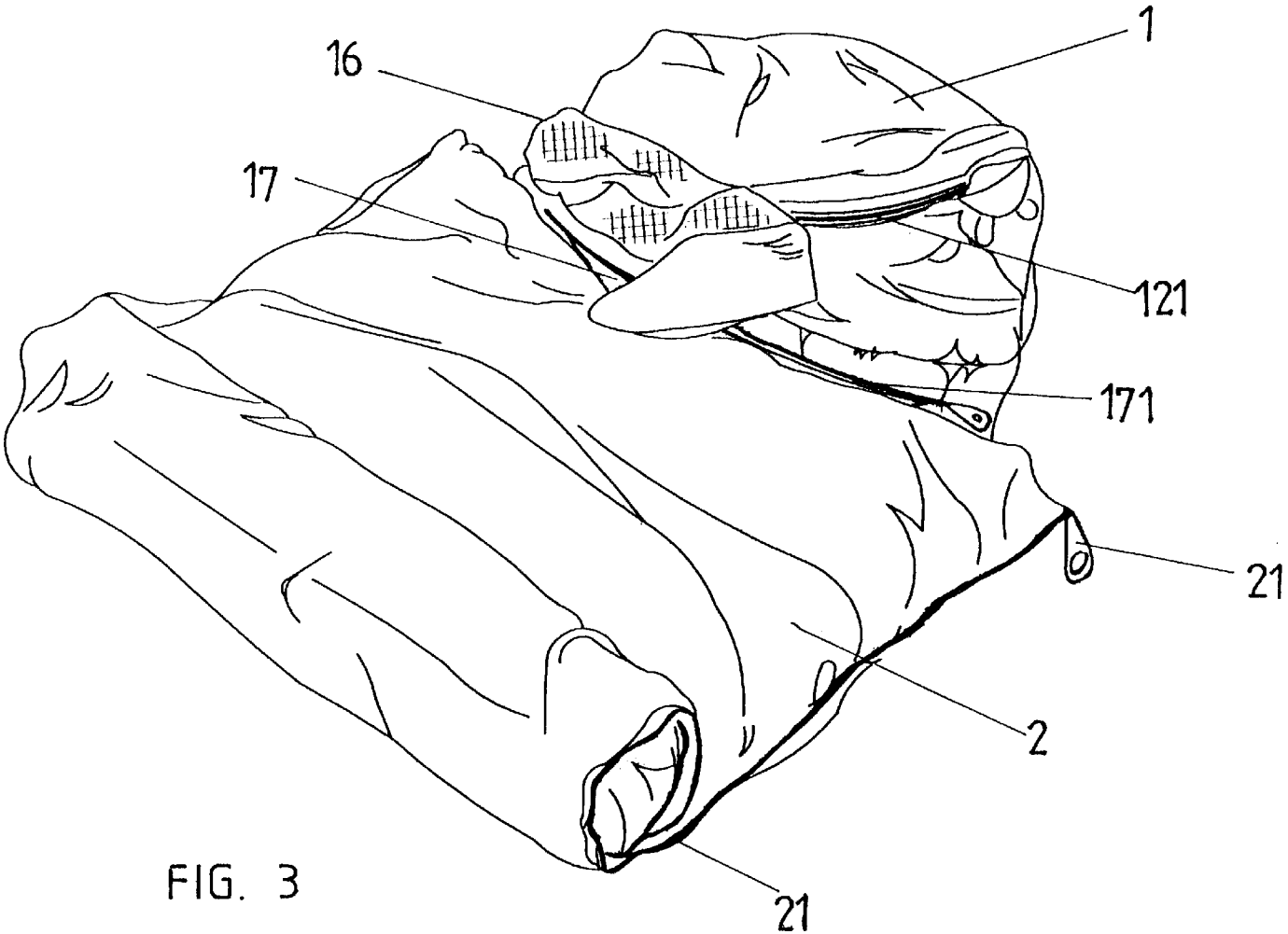
FIG. 3 is a perspective view of the knapsack-type sleeping bag of the present invention in an initially stretched state.

Please refer to FIGS. 1, 2 and 3 in which a knapsack-type sleeping bag according to the present invention is shown. The sleeping bag of the present invention mainly includes a knapsack portion 1 and a sleeping-bag portion 2 that can be folded and received in the knapsack portion 1 when it is not in use.

As can be seen from FIG. 1, the knapsack portion 1 is provided at a front with a first compartment 12 openably closed with a first zipper 121 for holding some items, such as medicines, snacks, etc., that are possibly needed in daily life, at a first side with a fishnet pocket 16 openably closed with a cord 161 for holding water bottles or canned beverage therein, at an upper part of a second side with a coin pocket 14 openably closed with a second zipper 141 for holding coins and other small-sized articles, and at a lower part of the second side with a mobile-phone pocket 15 openably closed with magic tapes 151 for securely holding a mobile phone therein.

As can be seen from FIG. 2, the knapsack portion 1 is provided at a back with a second compartment 13 openably closed with a third zipper 131 for holding items, such as toilet articles, underwear, etc., that are possibly needed in daily life, and two shoulder straps 11 for a user to conveniently carry the knapsack-type sleeping bag on back.

The knapsack portion 1 is characterized in an opening 17 provided at one of the first and the second sides of the knapsack portion 1 to be openably closed with a fourth zipper 171. The sleeping-bag portion 2, when it is not in use, is folded into a compact body and received in the knapsack portion 1 behind the opening 17. To use the sleeping-bag portion 2, simply unzip the fourth zipper 171 and pull the folded sleeping-bag portion 2 out of the opening 17, as shown in FIG. 3.

One edge of the sleeping-bag portion 2 is partially connected to a lining of the knapsack portion 1, so that the sleeping-bag portion 2 and the knapsack portion 1 are connected to each other to form an integral unit. The sleeping-bag portion 2 includes two connected outer covers made of, for example, a waterproof material and internally filled with cotton or other suitable insulation filling, so that the sleeping-bag portion 2 has reduced weight and provides good insulation, and is easily compressed and rolled or folded into a largely reduced volume for conveniently received in the knapsack portion 1 via the opening 17. When the sleeping-bag portion 2 is received in the knapsack portion 1, the entire sleeping bag of the present invention looks just like a knapsack and can be conveniently carried on the user's back.

Figure 4:
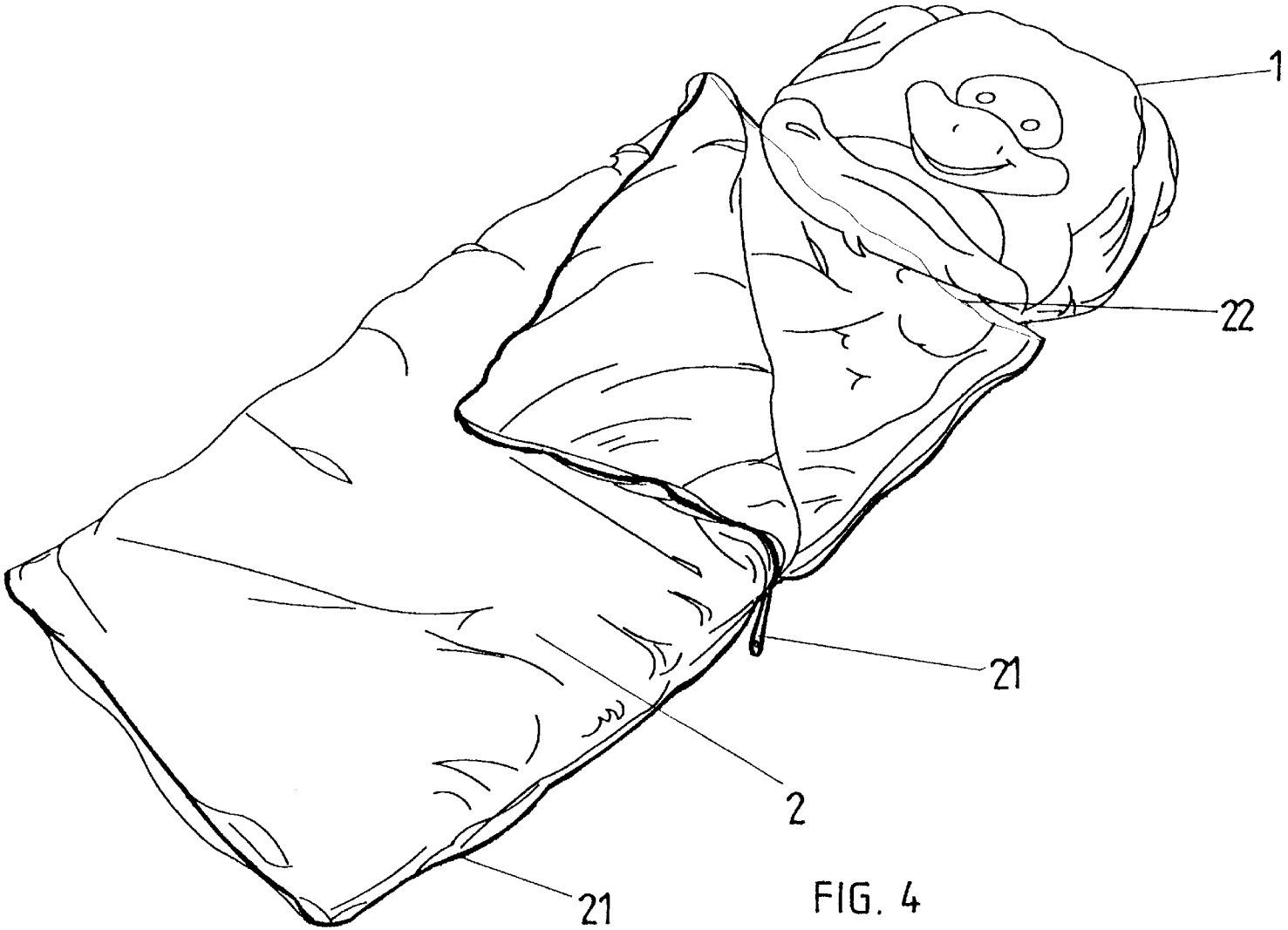
FIG. 4 is a perspective view showing the knapsack-type sleeping bag of the present invention is fully stretched with a zipper thereof in a zipped position.

Please now refer to FIG. 4. The sleeping-bag portion 2 is provided along three edges of four edges that are not connected to the knapsack portion 1 with a fifth zipper 21.

When the sleeping-bag portion 2 is in an extended position outside the opening 17 and the fifth zipper 21 is fully zipped up, the sleeping-bag portion 2 is folded up to form a bag having three closed edges and only one open edge 22. A lower part of the open edge 22 is integrally connected to the lining of the knapsack portion 1 via the opening 17, as previously described and as shown in FIG. 4. After the sleeping-bag portion 2 has been pulled out of the opening 17, the knapsack portion 1 can be folded and turned into the opening 17 to provide a head cushion, so that the user may sleep in the three-edge-zipped sleeping-bag portion 2 with his or her head comfortably rested on the head cushion.

Figure 5:
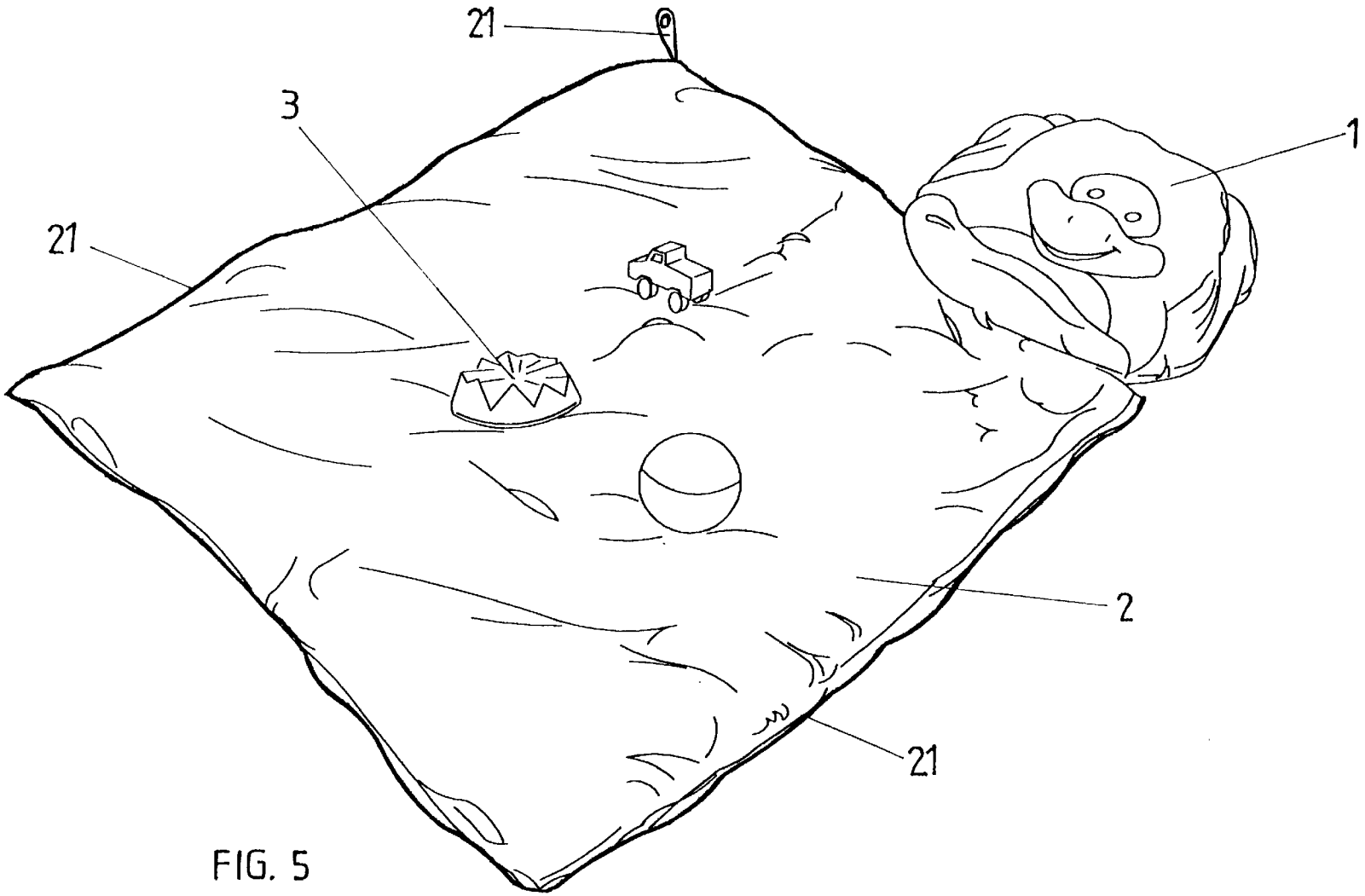
FIG. 5 is a perspective view showing the knapsack-type sleeping bag of the present invention is fully stretched and unzipped to provide an expanded pad.
Figure 6:
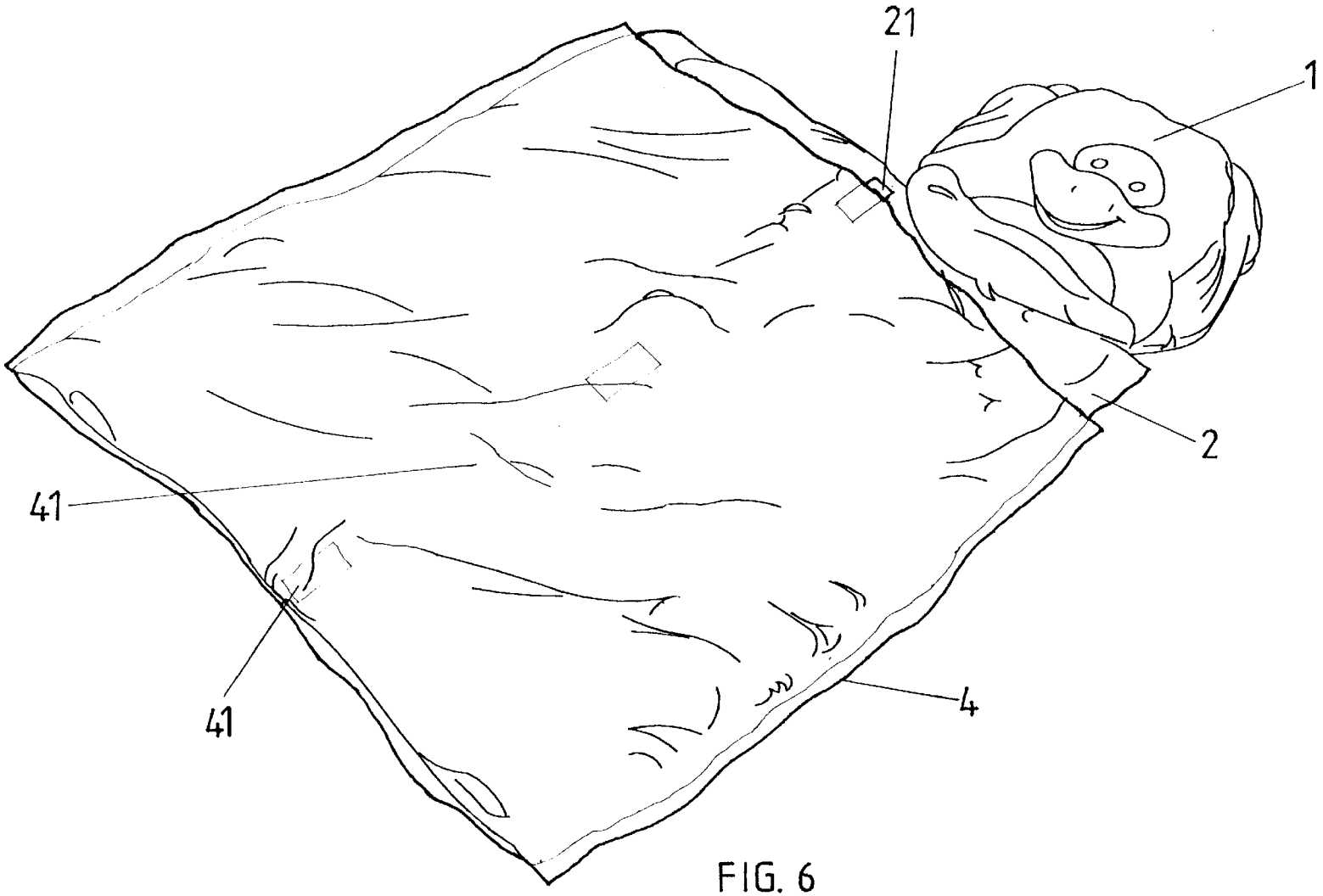
FIG. 6 is similar to FIG. 5 showing an additional waterproof and/or insulating fabric is detachably attached to an exposed inner side of the sleeping bag.

The sleeping-bag portion 2 may also be used in other manners. As shown in FIG. 5, the fifth zipper 21 can be fully unzipped so that the fully stretched sleeping-bag portion 2 can be turned open to provide an expanded pad. The sleeping bag of the present invention in this stretched and opened state is particularly suitable for children during outdoor activities. Toys 3 and other articles may be directly positioned on the opened sleeping-bag portion 2 for children to play. To avoid an inner side of the sleeping-bag portion 2 that is now exposed to the external environment from getting dirt, a waterproof and/or insulating fabric 4 may be attached to a top of the turned-open sleeping-bag portion 2 by providing along a top central line of the portion 2 with one or more pieces of hook tape 21 of a magic tape and along a bottom central line of the fabric 4 with one or more pieces of loop tapes 41 of the magic tape corresponding to the hook tapes 21, connecting the loop tapes 41 to the hook tapes 21, and smoothing the fabric 4 over the sleeping-bag portion 2. The fabric 4 may be easily removed from the sleeping-bag portion 2 after outdoor activities for cleaning.

The knapsack-type sleeping bag of the present invention allows a sleeping bag to be folded and received in a knapsack integrally connected to it, so that the knapsack functions not only as a knapsack but also a sleeping bag. The present invention is therefore very suitable for use in short-term trips or outdoor activities, and largely reduces the number of packages carried during trips and outdoor activities.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A knapsack-type sleeping bag, comprising a knapsack portion and a sleeping-bag portion integrally connected at a predetermined position to said knapsack portion;

said knapsack portion including two shoulder straps for a user to conveniently carry said knapsack portion on a back, and an opening provided at a predetermined position on said knapsack portion, the opening providing access into an interior of said knapsack portion; and said sleeping-bag portion having one edge at a head region of said sleeping-bag portion, the one edge being partially connected to a lining of said knapsack portion via said opening on said knapsack portion, and a zipper connected to and extended along another three edges of said sleeping-bag portion to openably close said three edges of said sleeping-bag portion; and said sleeping-bag portion being compressible and foldable into a compact body for positioning into and storing inside said knapsack portion via said opening;

wherein said opening on said knapsack portion is openably closed with a zipper, and wherein said knapsack portion can be folded and turned into said opening to provide a head cushion after said sleeping-bag portion has been pulled out of said knapsack portion via said opening.

* * * * *